United States Patent [19]

Howard et al.

[11] Patent Number: 4,667,426

[45] Date of Patent: May 26, 1987

[54] HYDRAULIC WING EXTENSION

[76] Inventors: Ralph E. Howard, RFD #1, Strong, Me. 04983; George Spector, 233 Broadway RM 3615, New York, N.Y. 10007

[21] Appl. No.: 822,762

[22] Filed: Jan. 27, 1986

[51] Int. Cl.[4] ..... E01H 5/04

[52] U.S. Cl. ..... 37/232; 37/281; 172/816

[58] Field of Search ..... 37/232, 105, 233, 231, 37/280, 281, 274; 172/705, 706, 711, 815, 816, 784, 794

[56] References Cited

U.S. PATENT DOCUMENTS

| | | | |
|---|---|---|---|
| 2,830,391 | 4/1958 | Bruno et al. | 37/105 |
| 3,231,991 | 2/1966 | Wandscheer et al. | 37/280 |
| 3,477,151 | 11/1969 | Zawella | 37/280 |
| 3,803,733 | 4/1974 | Ramsey | 37/274 |
| 3,807,064 | 4/1974 | Schmidt, Jr. | 37/281 |
| 4,073,077 | 2/1978 | Essel | 37/281 |
| 4,275,514 | 6/1981 | Maura | 37/281 |
| 4,369,847 | 1/1983 | Mizunuma | 172/815 |

*Primary Examiner*—E. H. Eickholt

[57] ABSTRACT

A snowplow with an extension blade is provided and consists of a main blade and an extension blade horizontally slideable within a track behind the main blade by a hydraulic cylinder assembly, whereby when the extension blade is completely retracted it will be totally behind the main blade. In a modification the extension blade contains individual spring biased vertically extending hands with the purpose of providing needed height when the extension blade is extended.

5 Claims, 3 Drawing Figures

HYDRAULIC WING EXTENSION

BACKGROUND OF THE INVENTION

The instant invention relates generally to plows and more specifically it relates to a snowplow with an extension blade.

Numerous plows have been provided in prior art that are adapted to have adjustable blades. For example, U.S. Pat. Nos. 3,477,151, 4,275,514 and Re. 31,045 all are illustrative of such prior art. While these units may be suitable for the particular purpose to which they address, they would not be as suitable for the purposes of the present invention as heretofore described.

SUMMARY OF THE INVENTION

A principle object of the present invention is to provide a snowplow with an extension blade that overcomes the shortcomings of the prior art devices.

Another object is to provide a snowplow with an extension blade whereby the extension blade is horizontally controlled by an apparatus on rear of main blade so that when the extension blade is completely retracted it will be totally behind the main blade.

An additional object is to provide a snowplow with an extension blade that has individual spring biased vertically extending panels therein so that when the extension blade is horizontally extended each panel will provide needed height for the extension blade.

A further object is to provide a snowplow with an extension blade that is simple and easy to use.

A still further object is to provide a snowplow with an extension blade that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
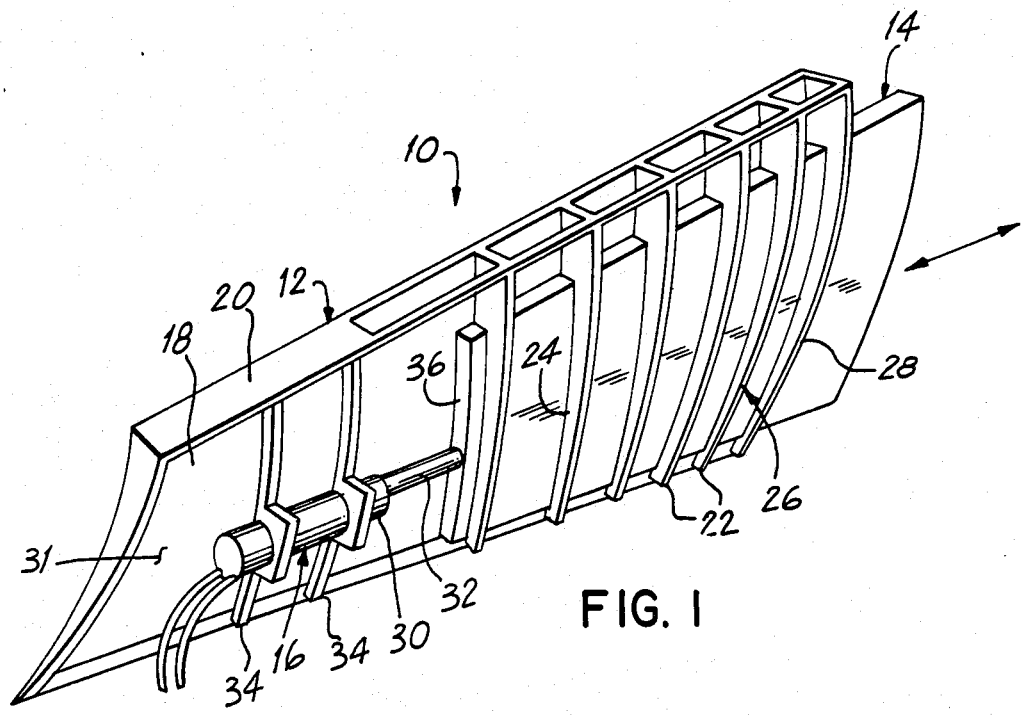
FIG. 1 is a rear perspective view of the invention with the extension blade in a partly extended position.
Figure 2:
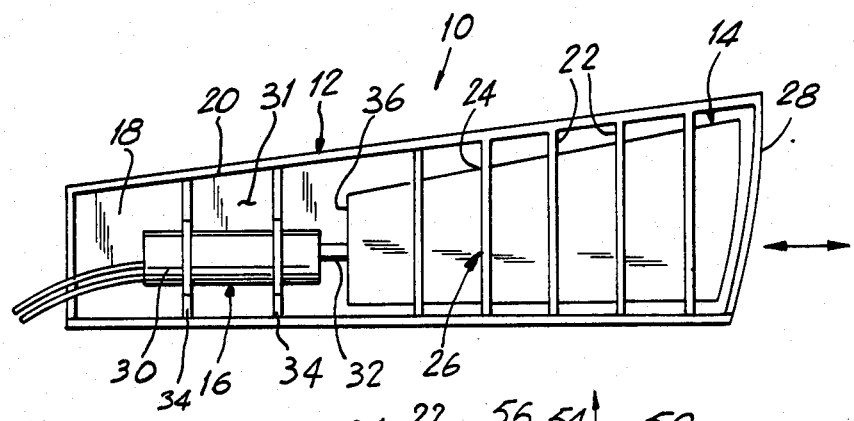
FIG. 2 is a rear elevational view of the invention with the extension blade in a completely retracted position.

Turning now descriptively to the drawings, in which similar reference characters denote similar elements throughout the several views, FIGS. 1 and 2 illustrate a snowplow 10 which contains a main blade 12, an extension blade 14 and a control device 16.

The main blade 12 has a front wall 18 to contact snow to be plowed and a reinforced rear frame 20 with a plurality of vertically spaced ribs 22. Each of the ribs 22 have a slot 24, thereby forming a track 26 within the ribs.

The extension blade 14 is horizontally slideable within the track 26 so as to extend outwardly from one side 28 of the frame 20 of the main blade 12.

The control device 16 is for sliding the extension blade 14 within the tack 26 to an extended position to increase width of the snowplow 10 and a retracted position to decrease width of the snowplow 10. When the extension blade 14 is in a completely retracted position, as shown in FIG. 2, it will be totally behind the front wall 18 of the main blade 12.

The control device 16 is a hydraulic cylinder assembly 30 and has a piston rod 32 connected to the extension blade 14. The hydraulic cylinder assembly 30 is mounted to the frame 20 on rear surface 31 of the front wall 18 of the main blade 12 via bracket arms 34 with the piston rod 32 connected to inner end 36 of the extension blade 14.

Figure 3:
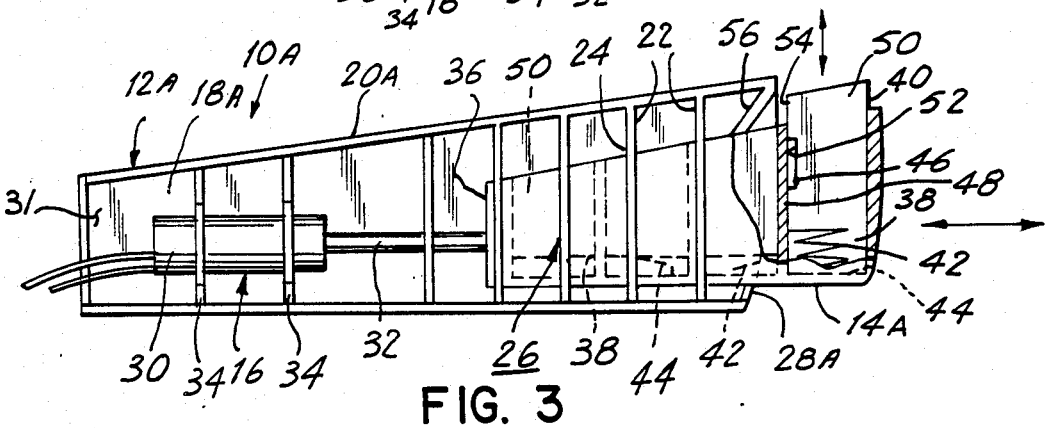
FIG. 3 is a rear elevational view of a modification with parts broken away showing the extension blade in a partly extended position and having individual spring biased vertically extending panels therein with the purpose of providing needed height for the extension blade.

FIG. 3 shows a modified snowplow 10A whereby the extension blade 14A has a plurality of vertically extending chambers 38 with open tops 40. A compression spring 42 is mounted within bottom 44 of each chamber 38 while a stop member 46 is mounted within one side 48 of each chamber 38. The extension blade 14A also contains a plurality of vertically extending panels 50. Each panel 50 has a guide slot 52 on matching side 54 to engage with one stop member 46.

When the extension blade 14A starts to extend outwardly from the side 28A of frame 20A of the main blade 12A, each of the springs 42 will push each of the panels 50 upwardly until each of the guide slots 52 are stopped by each of the stop members 46. Each of the panels 50 will provide needed height for the extension blade 14A.

The snowplow 10A further contains an inwardly angular upper rib segment 56 at the side 28A of the frame 20A of the main blade 12A. The rib segment 54 guides the panels 50 back into the chambers 38 of the extension blade 14A when the piston arm 32 of the hydraulic cylinder assembly 30 slides the extension blade 14A back into the retracted position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A snowplow with an extension blade which comprises:

(a) a main blade having a front wall to contact snow to be plowed and reinforced rear frame with a plurality of vertically spaced ribs, each of said ribs having a slot, thereby forming a track within said ribs;

(b) an extension blade horizontally slideable within said track so as to extend outwardly and from one side of said frame of said main blade; and (c) means for sliding said extension blade within said track to an extended position to increase width of said snowplow and a retracted position to decrease width of said snowplow, whereby when said extension blade is in a completely retracted position it will be totally behind said front wall of said main blade.

2. A snowplow as recited in claim 1, wherein said sliding means includes a hydraulic cylinder assembly having a piston rod connected to said extension blade.

3. A snowplow as recited in claim 2, wherein said hydraulic cylinder assembly is mounted to said frame on rear surface of said front wall of said main blade and said piston rod connected to inner end of said extension blade.

4. A snowplow as recited in claim 3, further comprising:

(a) said extension blade having a plurality of vertically extending chambers with open tops;

(b) a plurality of compression springs each of said springs mounted within bottom of each of said chambers;

(c) a plurality of stop members, each of said stop members is mounted within one side of each of said chambers; and (d) a plurality of vertically extending panels each of said panels having a guide slot on matching side to engage with one of said top members so that when said extension blade starts to extend outwardly from said side of said frame of said main blade each of said springs will push each of said panels upwardly until each of said guide slots are stopped by each of said stop members whereby each of said panels will provide needed height for said extension blade.

5. A snowplow as recited in claim 4, further comprising an inwardly angular upper rib segment at said side of said frame of said main blade, said rib segment guides said panels back into said chambers of said extension blade when said piston arm of said hydraulic cylinder assembly slides said extension blade back into said retracted position.

* * * * *